United States Patent [19]

Hamblin

[11] 4,437,568

[45] Mar. 20, 1984

[54] EMERGENCY FIRE AND SMOKE SAFETY KIT

[76] Inventor: Andrew Hamblin, 17450 Olive Tree Cir., Yorba Linda, Calif. 92686

[21] Appl. No.: 292,785

[22] Filed: Aug. 14, 1981

[51] Int. Cl.[3] ..... B65D 69/00

[52] U.S. Cl. ..... 206/223; 206/550; 206/570; 206/573

[58] Field of Search ..... 206/223, 550, 570, 572, 206/573, 231; 169/30, 51, 91; 312/245

[56] References Cited

U.S. PATENT DOCUMENTS

| | | | |
|---|---|---|---|
| 657,463 | 9/1900 | Simpson | 206/572 |
| 1,254,132 | 1/1918 | Garman | 312/245 |
| 1,278,790 | 9/1918 | Thunell | 312/245 |
| 1,930,180 | 10/1933 | Naylor | 312/245 |
| 3,254,756 | 6/1966 | Rankin | 206/231 |
| 3,371,771 | 3/1968 | Bugyi | 206/231 |
| 3,639,022 | 2/1972 | Elmo | 312/245 |
| 3,653,567 | 4/1972 | Salvaggio | 206/570 |
| 3,930,702 | 1/1976 | Pichowicz | 312/245 |
| 4,037,814 | 7/1977 | Clausen | 169/51 |
| 4,199,754 | 4/1980 | Johnson et al. | 340/577 |

*Primary Examiner*—William T. Dixson, Jr.
*Assistant Examiner*—Brenda J. Emhardt
*Attorney, Agent, or Firm*—Gilbert A. Thomas

[57] ABSTRACT

A metal fire and smoke emergency kit of generally rectangular cross section having a hinged front. Its contents enable one to extinguish a small fire, provide temporary first aid, provide emergency clothes and breathing apparatus to evacuate an area threatened by fire or fumes and attract attention enabling rescuers to locate people in danger of being trapped. Emergency instructions on the outside and inside of the hinged front are also provided. Only a fire extinguisher is mounted on the exterior of the case. The contents are protected from theft by a lead seal lock or optional room key.

4 Claims, 3 Drawing Figures

EMERGENCY FIRE AND SMOKE SAFETY KIT

BACKGROUND OF THE INVENTION

1. Field of the Invention

This invention relates to an emergency fire and smoke safety kit for use in hotels, apartments, high rise buildings, factories, cruise ships, at home or when traveling.

2. Description of the Prior Art

U.S. Pat. Nos. 3,895,625; 1,149,025; 3,254,756; 1,699,937; 3,371,771; 4,231,118 were examined in the patent search. None contain the quantity or variety of emergency equipment. U.S. Pat. No. 3,371,771 was the closest but is considered elementary when compared to this kit.

SUMMARY OF THE INVENTION

It has been found highly desireable for the inclusion of a fire and smoke safety kit in many of the everyday situations of life. Those that live in or frequent high rise buildings, factories, that travel on cruise ships, that live at home or travel more than occasionally will find this invention especially useful.

Accordingly, it is a primary object of this invention to provide an improved fire and smoke kit which contains an alarm to warn people of the presence of fire and fumes.

It is also an object of this invention to provide means to extinguish a small fire.

It is another object of this invention to help one against the presence of extensive smoke or fumes.

It is still another object of this invention to provide easy access to a first aid kit.

It is still a further object of this invention to provide a means of signaling would-be rescuers when individuals are in danger of being trapped.

It is another object of this invention to enable trapped people to escape from fire or fume-laden structures without being overcome.

It is still another object to provide a smoke and fume emergency kit that will be protected from smoke and fumes by being composed of metal.

These and other objects will be apparent from the following description, the attached claims and the drawings.

DESCRIPTION OF THE PREFERRED EMBODIMENT

Figure 1:
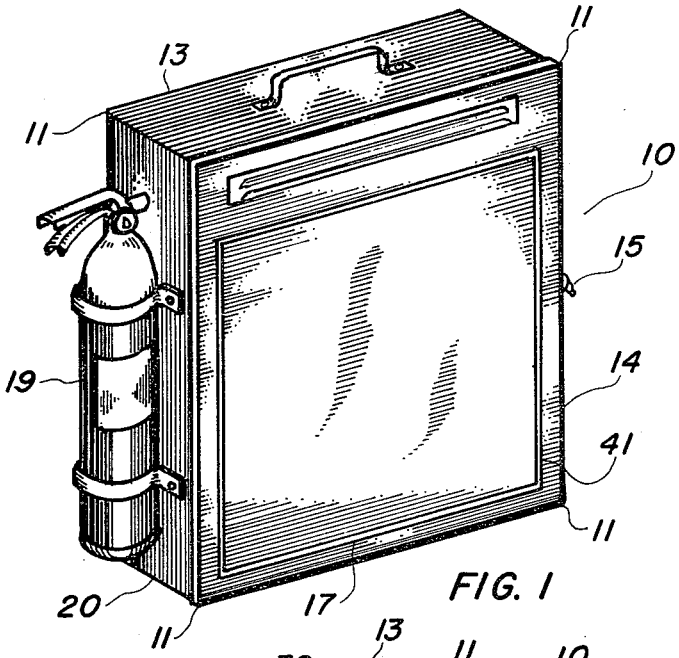
FIG. 1 is an exterior view of the fire and smoke emergency kit of this invention.
Figure 2:
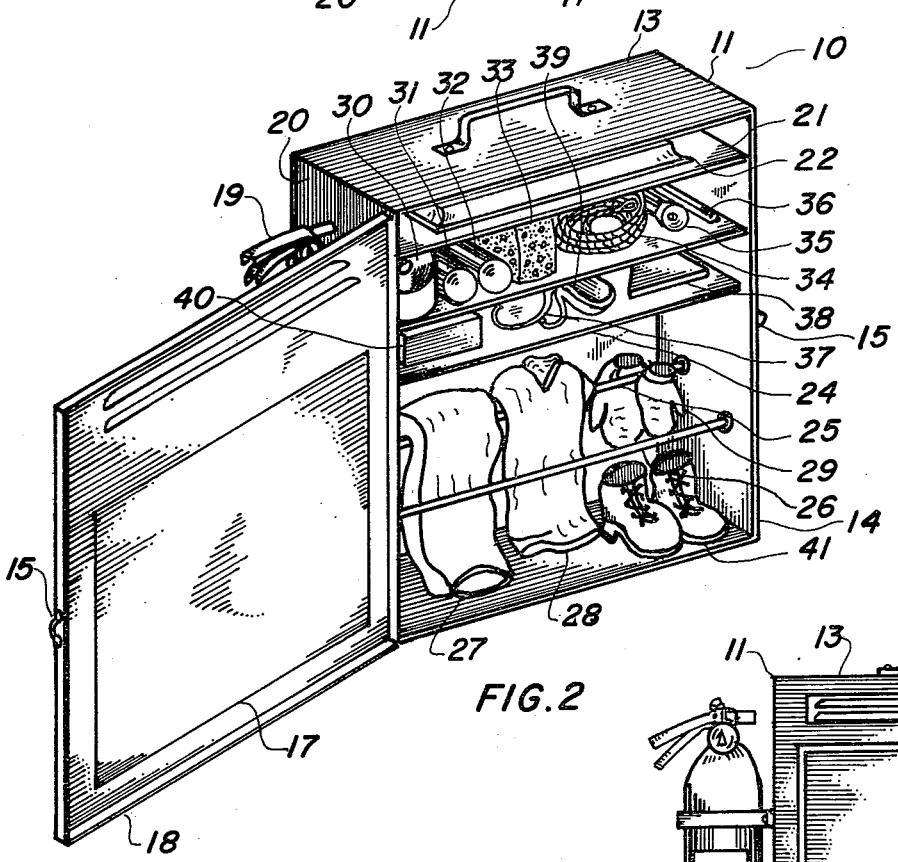
FIG. 2 is an exterior view with the front side open exposing the contents of the kit of this invention.
Figure 3:
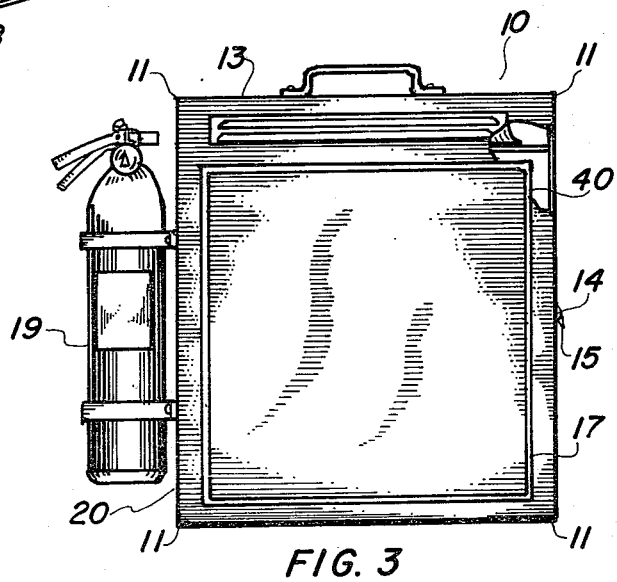
FIG. 3 is a front view of a decorative front panel for use on this invention.

The objects of this invention are achieved by a metal emergency kit 10 that is formed by shearing, forming, spotwelding and applying baked enamel inside and out. The corners 11 are rounded or at least a small radius is formed. A handle for carrying the kit when traveling is included on top side 13.

Attached to the right side 14 are two hasps 15 to which either a lead seal lock or optional room key lock is attached. A fire extinguisher 19 effective against small blazes is attached to the left side 20. The front cover 18 is hinged along the left side by exterior hinges (not shown). An instruction placard or sheet 17 is fastened to the outside and inside of front cover 18. Inside the box is a top closed compartment, the top side being enclosed by top 13 and the bottom by shelf 21. Within the compartment are the batteries and wiring for a conventional smoke and flame alarm 22. Immediately below is a shelf forming a compartment on which the following items are stored. Two rolls 2" tape 30 are to seal vents, doors, cracks, etc. Next is an air horn 31 to attract help. A can of flourescent spray paint 32 is included to spray signs or marks on windows, roofs, or other open areas to attract rescuers. Next on the shelf 23 are two heavy duty sponges 33 to wet down any object desired. A safety cord 34 at least twelve feet long with loops at both ends to help guide people in dangerous situations. A flashlight 35 provides illumination in emergency situations when electric power fails. A glass cutter 36 completes the items on the shelf 23. Another shelf 24 is located about four inches below shelf 23. On the next shelf 24 are two respirators 37 to protect one's nose and mouth from smoke and dangerous fumes. A form of activated carbon is most efficient for use therein and is not shown. Two folded red flourescent triangles 38 can be tied to balconies, windows, or doors. The word help is preprinted on the face of the triangle in contrasting colors. Two pair of air tight goggles, 39 are next on shelf 24. Finally first aid kit 40 contains supplies to administer elementary aid to accident victims is last located on the shelf.

Below the last shelf 24 about three inches is rod 25 and below that five inches is rod 26. Over each of these rods are two pairs of heat and flame resistant pants 27, hooded jacket 28, gloves 29 and bootlike foot coverings 41. These objects 27, 28, 29, and 41 enable an individual to exit from a flame or smoke blocked area.

It can be seen to the average individual that the presence of kit 10 fully equipped as indicated would be of immeasurable help in emergency situations. A decorative cover 41 may be snapped over cover 18 when conditions require it.

It is believed that the many objects of this invention and safety features will become apparent to those skilled in the art. The foregoing description is illustrative only. The invention is only limited by the attached claims.

I claim:

1. A rectangular emergency kit for use in fire, flame or smoke situations comprizing in combination:

a rectangular metal box with an earring handle;

a front on said box;

a hinged lid means, all corners on said box are given a radii;

two hasps for closure attached by locking means to the lid means and right side, first aid instructions are attached or printed on the inside and outside of said lid means;

a smoke and fire alarm and self-contained batteries are accomodated in the top space;

next is a three inch space defined by a shelf extending from back to the lid means;

stored on the shelf are:

two rolls of two inch tape, an air horn, a can of flourescent red paint, two heavy duty sponges, a glass cutter, a flashlight, a second space four inches in width defined by a back to lid means shelf;

on the second shelf are:

two respirator masks, two folded florescent red triangles preprinted with the signal and word "help", two pair of flame resistant goggles, a first aid kit, a third space defined by the bottom of the box to accomodate:

two pair of fire resistant pants, two pair of fire resistant gloves, two pair of flame resistant jackets, two pair of water and flame resistant boots, two rods to hold the above items, and a fire extinguisher attached by fastening means to the left exterior of the box.

2. The fire and smoke emergency kit described in claim 1 in which the locking means is a variable heat melting composition or a conventional lock and key.

3. The fire and safety smoke emergency kit described in claim 1 in which the lid means may have a decorative scene on the exterior of the lid instead of first aid instructions 4. A fire and smoke emergency kit as described in claim 1 in which the fastening means are two pairs of lockable, flexible metal strips.

* * * * *